United States Patent [19]

Brown

[11] 3,931,035

[45] Jan. 6, 1976

[54] SOAP BAR

[76] Inventor: Theodore G. Brown, 4401 Lantana Ave., Sacramento, Calif. 95824

[22] Filed: Apr. 2, 1975

[21] Appl. No.: 564,342

[52] U.S. Cl. ..... 252/134; 252/90; 252/92; 252/93; 252/174; 252/DIG. 16

[51] Int. Cl.[2] ..... C11D 9/00; C11D 13/14; C11D 17/00; C11D 17/04

[58] Field of Search ..... 252/90, 92, 93, 134, 174, 252/DIG. 16

[56] References Cited

UNITED STATES PATENTS

| | | | |
|---|---|---|---|
| 1,320,855 | 11/1919 | Henderson | 252/90 |
| 1,495,978 | 6/1924 | Anderson | 252/134 |
| 3,553,138 | 1/1971 | Male | 252/90 |

FOREIGN PATENTS OR APPLICATIONS

| | | | |
|---|---|---|---|
| 734,565 | 8/1932 | France | 252/134 |
| 1,195,697 | 5/1959 | France | 252/134 |
| 7,935 | 5/1898 | United Kingdom | 252/134 |

*Primary Examiner*—Dennis L. Albrecht
*Attorney, Agent, or Firm*—John N. Randolph

[57] ABSTRACT

A soap bar composed of a hollow shell of bar soap material defining a cavity filled by a core composed of small remaining pieces of soap bars and a congealed mass of a soap solution. The shell has an access opening through which the soap pieces and solution, in a fluent form, are applied to the cavity.

4 Claims, 3 Drawing Figures

SOAP BAR

SUMMARY

It is a primary object of the present invention to utilize the small remaining pieces of soap bars which are normally thrown away due to their size making it substantially impossible to utilize such pieces in the normal manner that soap bars are utilized.

More particularly, it is an object of the present invention to provide a bar or cake of soap composed of a thin shell of soap bar material having a large cavity and a restricted access opening through which the cavity can be substantially filled with soap bar remnants and the remaining space hereafter filled with a soapy solution in liquid, cream or paste form, which, when congealed, will form a substantially solid core of a shape and size to conformably fill said cavity.

Various other objects and advantages of the invention will hereinafter become more fully apparent from the following description of the drawing, illustrating a presently preferred embodiment thereof, and wherein:

DESCRIPTION OF THE PREFERRED EMBODIMENT

Figure 3:
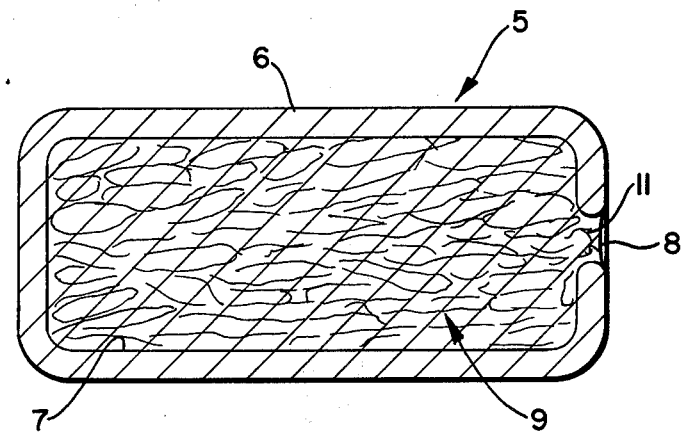
FIG. 3 is a similar view of the complete soap bar consisting of the shell, remnants and the congealed soap solution.

Referring more specifically to the drawing, the soap bar in its entirety, as illustrated in FIG. 3, is designated generally 5 and includes a shell 6 of bar soap material of a thickness sufficient to render it substantially rigid. Preferably, the shell 6 is of a size and shape corresponding to conventional bars of hand soap; however, the size and shape of the shell 6 and, accordingly, the bar 5 may obviously vary. The shell 6 defines a large cavity 7 and said shell is provided with an access opening 8, preferably in an end thereof, communicating with the cavity 7 and the exterior of the shell.

Figure 2:
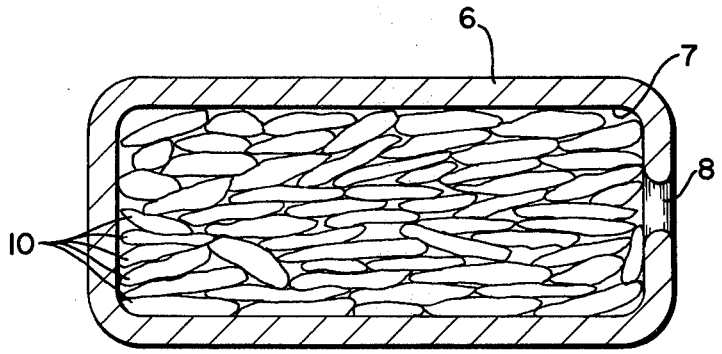
FIG. 2 is a similar view showing the cavity of the shell filled with soap bar remnants.

As seen in FIG. 3, the bar 5, in addition to the shell 6, is composed of a solid core 9. The core 9 includes a plurality of small pieces or remnants 10 of soap bars which have been worn down through use to a size so small that said pieces 10 cannot be conveniently utilized in a conventional manner. The opening 8 is of sufficient size so that the remnants 10 can be passed inwardly therethrough for substantially filling the cavity 7, as illustrated in FIG. 2. The remainder of the cavity 7, preferably including the opening 8, is then filled with a soap solution 11 in either liquid, cream or paste form which is allowed to congeal and solidify to provide the core 9 which is of a size and shape to completely fill the cavity 7 and opening 8, as illustrated in FIG. 3.

The solution 11 may be formed in various ways, such as by collecting small remnants of soap bars in a pliable plastic receptacle to which water is added and let stand until the soap remnants are dissolved or are sufficiently soft so that they can be dissolved by kneading the receptacle, to form a cream or paste which can be poured into the cavity 7, or exuded from the container into said cavity through the opening 8. The solution 11 may also comprise a liquid, such as water, poured into the cavity through the opening 8 and allowed to set until it has softened the soap remnants 10 and has been absorbed thereby to provide a soapy solution which thereafter congeals to form the core 9.

It will be apparent that the bar 5, after the core 9 has hardened, can be utilized in the same manner as a conventional bar of soap.

Various modifications and changes are contemplated and may be resorted to, without departing from the function or scope of the invention.

Figure 1:
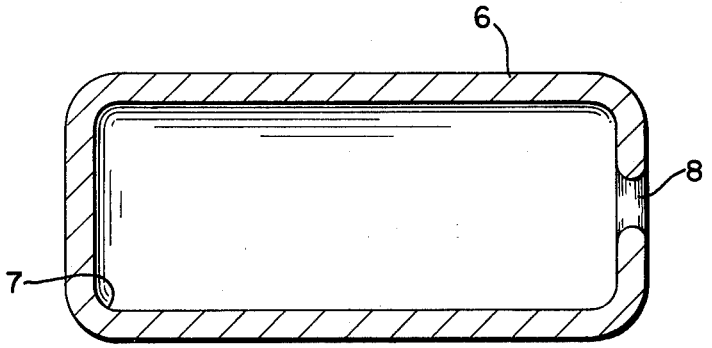
FIG. 1 is a longitudinal sectional view showing the soap bar shell.

I claim as my invention:

1. A soap bar comprising a hollow shell of bar soap material defining a large cavity and an access opening, said shell, cavity and access opening having the configuration shown in FIG. 1, and a hard core of soap material of a size and shape substantially filling said cavity.

2. A soap bar as in claim 1, said core being composed of a multiplicity of bar soap remnants and a congealed soap solution in which said remnants are imbedded.

3. A soap bar as in claim 2, said shell having an access opening for initially receiving the soap bar remnants and thereafter a soapy solution in cream, paste or liquid form.

4. A soap bar as in claim 3, and a portion of the congealed soap solution filling said access opening.

* * * * *